United States Patent [19]

Porter

[11] Patent Number: 4,955,112

[45] Date of Patent: Sep. 11, 1990

[54] TIE CLIP

[76] Inventor: Joseph B. Porter, 20 Meadow La., Albany, N.Y. 12208

[21] Appl. No.: 433,326

[22] Filed: Nov. 8, 1989

[51] Int. Cl.[5] ..... A41D 25/04

[52] U.S. Cl. ..... 24/49 C; 24/49 CF

[58] Field of Search ..... 24/49 R, 49 TS, 49 CF, 24/49 CC, 49 S, 49 CP, 49 P, 54, 10 A, 3 R, 3 F, 3 J; 2/145, 11

[56] References Cited

U.S. PATENT DOCUMENTS

| | | | |
|---|---|---|---|
| 693,442 | 2/1902 | Redhead | 24/49 KC |
| 1,220,212 | 3/1917 | Ferris | 24/3 J |
| 1,273,094 | 7/1918 | Rigot, Jr. | 24/49 C |
| 1,291,090 | 1/1919 | Nuzum | 2/145 |
| 2,389,784 | 11/1945 | Kennedy | 24/49 TS |
| 2,893,086 | 7/1959 | Parker | 24/49 CP |
| 3,400,434 | 9/1968 | Pazeotopoulos | 24/49 TS |
| 4,827,576 | 5/1989 | Prince, Jr. | 24/49 TS |
| 4,835,821 | 6/1989 | Durante | 24/49 CF |

*Primary Examiner*—Victor N. Sakran

*Attorney, Agent, or Firm*—Schmeiser, Morelle & Watts

[57] ABSTRACT

The instant invention is a "T" shaped tie clip. The clip is designed to be used in conjunction with the tie loop commonly found on the rear surface of one of the tie ends. The top portion of the clip grippingly engages the shirt and the bottom portion of the clip extends into the tie loop.

18 Claims, 1 Drawing Sheet

TIE CLIP

FIELD OF THE INVENTION

The instant invention is in the field of article retaining devices and more particularly, in the field of tie clips. In use, the invention function to retain a tie in place adjacent the center portion of a shirt front.

BACKGROUND OF THE INVENTION

For great number of years, ties have been used as an important part of business or formal attire. Once tied, the top of the tie is secured within the user's shirtcollar and the lower ends of the tie lie adjacent the center part of the user's shirt front. In a standard tie, one of the ends is a wide end and this end rests atop the other, narrower end. Commonly, the rear surface (side facing the user) of the wide end includes a tie loop through which the narrow end passes. This loop maintains the position of the narrow tie end behind the wide end.

Unless the ends of the tie are somehow fastened in place, they can move away from the shirt front and thereby cause numerous problems. On a windy day, the ends can be blown about and cause the user to appear disheveled. While eating, if the user leans forward, the tie can swing outward and brush against food and become soiled. There have even been instances when the user's tie has become caught in rotating machinery (such as an automobile fan) and thereby become associated with injury to the user.

To avoid the above noted problems, a number of tie clips and restraining pins have been invented and used. The following inventors have patented devices to retain the bottom ends of a tie in place.

Mates—Clip that fastens the narrow tie end to the shirt. An exterior portion of the clip has velcro which mates with and secures a complementary strip of velcro stitched or adhesively retained on the rear side of the side tie end. Mates also notes that the standard loop may have a button hole (col. 1, line 48).

Slimovitz—Teaches the use of a two-piece attachment device wherein one piece attaches to the shirt with a safety pin and the other piece attaches to the tie with a pin and clip. The two pieces are then connected together via complementary velcro strips on each piece.

Luft—Shows a one piece clip that has one portion that attaches to the shirt and another portion that slidingly fits around a portion of the tie.

Konnan—Teaches a tie retaining device having three portions, A first horizontal portion is permanently attached to the rear side of the wide end of a tie. The second portion is a flexible band or chain permanently and slidingly attached to the first portion. The last portion of the device is a clip permanently attached to the end of the second portion and used to clamp onto a part of the shirt.

Weed—Shows a tie clip that includes one portion for gripping the rear side of the wide end of a tie and another portion that attaches to the shirt front. The small end of the tie is gripped between the two portions.

Burns—Teaches a three-part necktie holder in which one part fastens to a shirt button and another part clamps onto the wide end of the tie. The third part flexibly connects the two other parts.

SUMMARY OF THE INVENTION

The instant invention is a tie clip that is simple to use, easy to make and inexpensive to produce. The clip, in the preferred embodiment, is a one-piece device that is "T" shaped and designed to be used with ties that have a tie loop attached to the wide end. The top, horizontal portion of the device incorporates a gripping means that can be attached to the overlying portion of the shirt front that includes the button holes. The gripping means is in the form of a clip that, in cross-section, is similar to a bobby pin type of hair pin. In this preferred embodiment, the device is manufactured from a plastic or metallic material that has some degree of resiliency to provide the gripping action. The lower portion of the device the vertical or base part of the "T", is designed to fit within the tie loop. It is typically square or rectangular in shape and of a length to at least partially extend into the tie loop. Ideally, this lower portion will be on the order of one to three inches in length so that it can extend through the loop and allow some vertical movement of the tie without the tie disengaging from the clip. In addition, a long length is desirable so that the gripping portion can be placed on the shirt front spaced from the button and still have the lower portion extend to the tie loop.

In practice, the gripping portion can have other shapes or styles and the function of the device would be unimpaired. For instance, the gripping portion could be in the form of an alligator clip. This would have an identical function but would greatly increase the costs and complexity of the device.

To use the device, the user would locate and tie the tie in the usual manner with the narrow tie end received within the tie loop of the wide end. Next, the user would take the clip and insert its lower portion downwardly into the tie loop between the loop and the narrow end o( the tie. The user would then simply horizontally slide the gripping portion of the clip onto the overlying portion of the shirt front between the button holes. The tie is now retained in place and the wide end of the tie completely covers and makes invisible the clip.

In an alternate manner of use the lower portion of the clip can be received into the tie loop between the wide end of the tie and the narrow end of the tie. The narrow end of the tie would then also pass through the upper or clip portion of the clip. When the user would finally attach the clip to the shirt front, both the narrow end of the tie and a portion of the shirt front would be sandwiched within the clip. In this alternate embodiment as in the other embodiment, the wide end of the tie would completely cover and make invisible the clip.

DESCRIPTION OF THE PREFERRED EMBODIMENT

Figure 1:
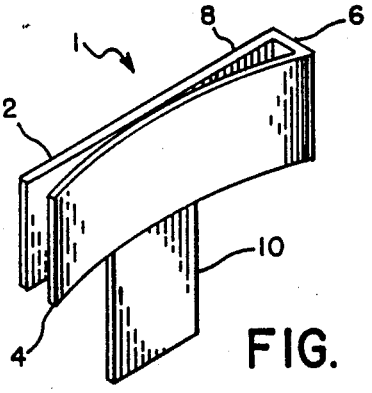
FIG. 1 shows an isometric view of the device.

Referring to FIG. 1, the instant invention is a tie clip 1 that is preferably in the form of a "T". The top portion 2 comprises an inner portion 4, side portion 6 and outer portion 8. Extending downwardly and perpendicularly from the outer portion is bottom portion 10.

Figure 2:
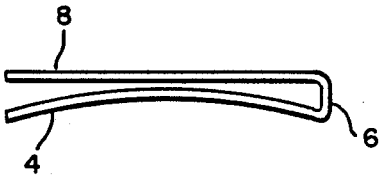
FIG. 2 cross-sectional view of the device.

FIG. 2 is a cross-sectional view of the device shown in FIG. 1. In this figure, one can readily see that the top portion 2 of the device is shaped like a bobby pin type of hair pin. The top portion has a gripping function and the material from which it is fashioned has a degree of resiliency. The inner portion 4 can be manually spread apart from the outer portion 8 and a material can be placed between the two portions. When the portions are released, they tend to spring back toward the shape shown in this figure and thereby grip the sandwiched material.

Figure 3:
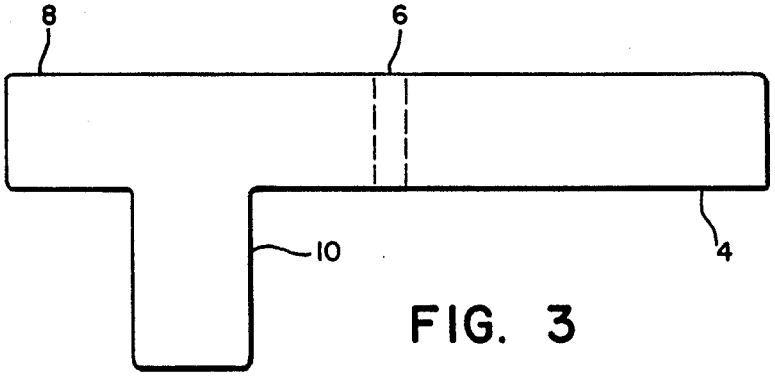
FIG. 3 a view of the initial material prior to bending.

FIG. 3 shows an example of the starting material from which the clip is fashioned. Portion 4 is bent 180 degrees to lie approximately directly in front of portion 8. This bending operation would typically be done with a metallic material or could be accomplished with a suitably heated plastic material such as a thermoplastic. Alternatively, the deVice can be molded in finished form from a plastic and thereby require no bending operation.

Figure 4:
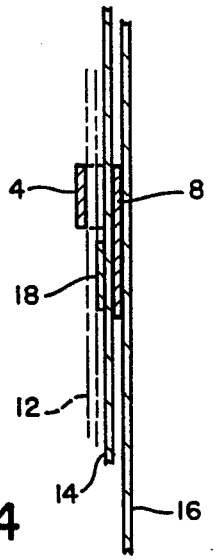
FIG. 4 is a cross-sectional view showing the device retaining a to a shirt front.

FIG. 4 shows the device in use As shown, clip portion 4 is located behind the overlying buttonholed central shirt portion 12. Sandwiched between the inner clip portion 4 and the outer clip portion 8 is the narrow end 14 of a tie. The wide, outer tIe end 16 overlies both the narrow tie end and the clip. The inner surface of the wide tie end includes a tie loop 18. This loop is commonly found on commercially sold ties. Received within this loop is the narrow tie end, as is commonly done, and the lower portion 10 of the clip. In this way the ends of the tie are securely attached to the shirt front.

Figure 5:
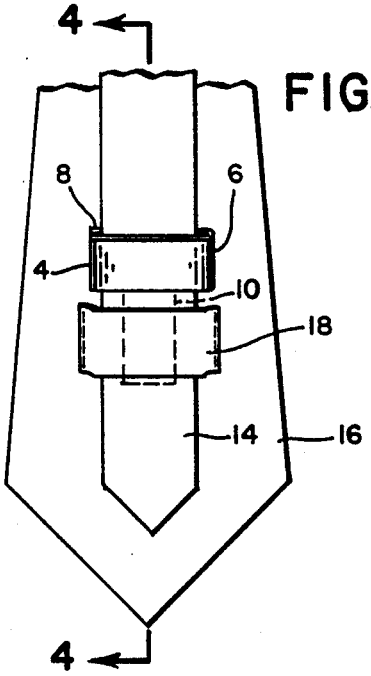
FIG. 5 is a rear view showing the device located on a tie.

FIG. 5 shows the device located on a tie just prior to attaching to the shirt front. In this view, one can easily see the tie loop 18 and the placement of the clip lower portion and the narrow tie end within the loop.

Alternatively, but not shown, both ends of the tie can be in front of the clip. The clip lower portion 10 would extend downwardly into the loop and would thus be located between the inner loop surface and the small end of the tie. In this manner of placement, the upper portion of the clip (4,6,8) would be fastened solely onto the shirt front. In this embodiment, the tie could move vertically a short distance without the clip portion 10 disengaging from the loop. In this manner, the user would be provided with freedom of movement.

The tie clip as disclosed is simple in design. The shape of the lower portion 10 is shown as being rectangular. Its length would be preferably between one -half inch and 3 inches. The length should be sufficient to allow some vertical movement of the tie if the latter described method of use is used. Also, should a button be located just above the tie loop, the increased length of the bottom portion allows fastening the clip above the button with the downward clip portion still having sufficient length to extend down to and be received within the tie loop. The width of portion 10 should be within the range of one-quarter inch and one and a half inches so that it can fit within the width of most tie loops.

The upper gripping portion of the clip should have a width of between one-half inch and two and a half inches so that it can firmly engage the shirt front. Obviously, the width should be less than the tie width so that the clip can not be seen when it is in use. The height of the upper portion of the clip should be between one-eighth inch and one and a half inches. The one-eighth inch height would be similar to that of a bobby pin type of hair pin.

The embodiment disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention.

I claim:

1. A necktie retainer comprising:
   - a first portion having a shape whereby it can extend into a tie loop and be free to vertically move therein; and
   - a second portion attached to said first portion, said second portion including means for grasping a portion of a shirt wherein said grasping means includes a member which is shaped to fit inbetween overlapping shirt layers.

2. The retainer of claim 1 wherein said means for grasping a portion of a shirt comprises a hairpin shaped piece of resilient material.

3. The retainer of claim 1 wherein said device is in the form of a "T" with said first portion making up the vertical base of the "T" and said second portion making up the horizontal top portion of the "T".

4. The retainer of claim 1 wherein said first portion extends perpendicularly downward from the second portion.

5. The retainer of claim 1 wherein said device is fashioned from a single piece of material and said gripping means is comprised of one portion of said material being bent 180 degrees from another portion of said material.

6. A necktie retainer consisting essentially of:
   - a first portion having a shape whereby it can extend into a tie loop and be free to vertically move therein; and
   - a second portion attached to said first portion, said second portion comprising gripping means for gripping onto a portion of a shirt front wherein said gripping means includes a member which is adapted to fit inbetween overlapping shirt layers.

7. The retainer of claim 6 whereby said retainer is in the form of a "T" with said first portion forming the base of the "T" and said second portion forming the horizontal top portIon of the "T".

8. The retainer of claim 6 wherein said gripping means has a cross-sectional shape similar to a bobby pin.

9. The retainer of-claim 6 wherein said retainer is formed from a single bent piece of material.

10. The retainer of claim 6 wherein said first portion has a length of between one-half inch and 3 inches.

11. The retainer of claim 6 wherein said first portion has a width of between one-quarter inch and one and a half inches.

12. A necktie retainer comprising:
   - a first tab shaped portion for slidingly passing through a tie loop wherein once inside said loop, said tab shaped portion is free to vertically move therein; and
   - a second portion attached to said first portion, said second portion being approximately perpendicular to and above said first portion and having a shape which can grippingly sandwich a top shirt layer in a portion of a shirt front that includes overlapping shirt layers.

13. The retainer of claim 12 wherein the second portion has a shape in cross-section which approximates that of a bobby pin.

14. The retainer of claim 12 wherein said retainer is formed from a single piece of material and said second portion comprises a bend in said material.

15. The retainer of claim 12 wherein said first portion has a length of between one-half inch and 3 inches.

16. The retainer of claim 12 wherein said first portion has a width of between one-quarter inch and one and a half inches.

17. The retainer of claim 12 wherein said second portion has a height of between one-eighth inch and one and a half inches.

18. The retainer of claim 12 wherein said second portion has a width of between one half inch and two and a half inches.

* * * * *